US006771151B1

(12) United States Patent
Bach et al.

(10) Patent No.: US 6,771,151 B1
(45) Date of Patent: Aug. 3, 2004

(54) DEVICE FOR ARRANGING THE ACTUATING SHAFT OF A LOW-VOLTAGE CIRCUIT-BREAKER AND MULTIPOLE LOW-VOLTAGE CIRCUIT BREAKER WITH A DEVICE FOR ARRANGING THE ACTUATING SHAFT

(75) Inventors: Michael Bach, Berlin (DE); Detlev Schmidt, Berlin (DE); Michael Sebekow, Berlin (DE); Guenter Seidler-Stahl, Berlin (DE); Ingo Thiede, Berlin (DE); Sezai Tuerkmen, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 102 days.

(21) Appl. No.: 10/089,304

(22) PCT Filed: Sep. 15, 2000

(86) PCT No.: PCT/DE00/03261

§ 371 (c)(1),
(2), (4) Date: Mar. 29, 2002

(87) PCT Pub. No.: WO01/24208

PCT Pub. Date: Apr. 5, 2001

(30) Foreign Application Priority Data

Sep. 30, 1999 (DE) ..... 199 48 716

(51) Int. Cl.[7] ..... H01H 75/00
(52) U.S. Cl. ..... 335/8; 335/172; 335/202
(58) Field of Search ..... 335/8–10, 166–176, 335/202, 23–25, 35–42, 16, 147, 195; 218/22

(56) References Cited

U.S. PATENT DOCUMENTS 5,735,611 A 4/1998 Godesa

FOREIGN PATENT DOCUMENTS

DE 44 16 090 C1 4/1998
DE 197 39 702 C1 9/1999

*Primary Examiner*—Lincoln Donovan
(74) *Attorney, Agent, or Firm*—Harness, Dickey & Pierce, P.L.C.

(57) ABSTRACT

In order to provide a bearing for an already prepositioned switching shaft, fitted with coupling levers, of a low-voltage circuit breaker in the region where the switching forces act, a bearing assembly is provided. The bearing assembly includes a bearing body which is mounted on the housing front wall of the switch pole, surrounding the switching shaft in the form of a half shell. The bearing body includes a subregion which projects between two coupling levers, which are at a distance from one another and are connected to a movable switching contact. It thus forms side guide surfaces for the coupling levers. Such a bearing assembly can be arranged in both the end regions of the switching shaft in multipole circuit breakers.

10 Claims, 2 Drawing Sheets

FIG 1
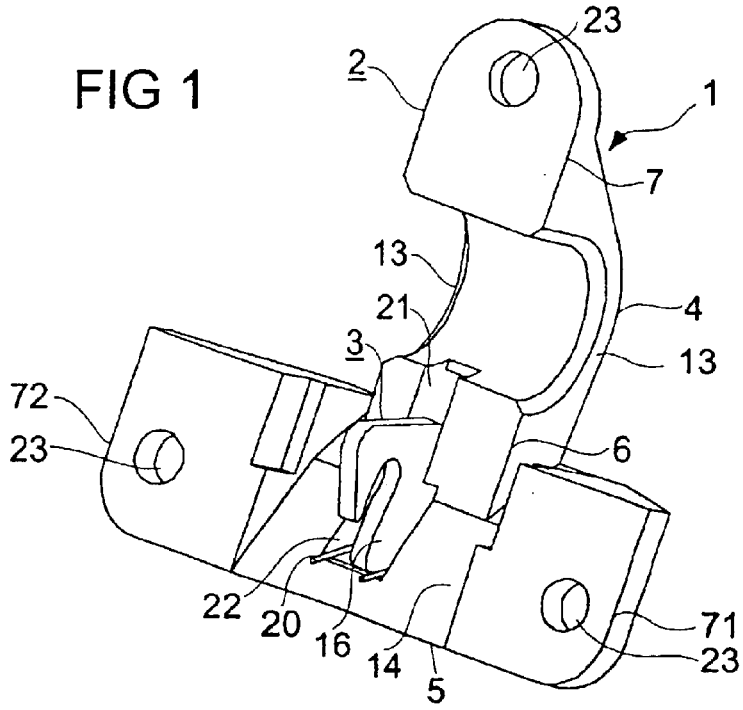
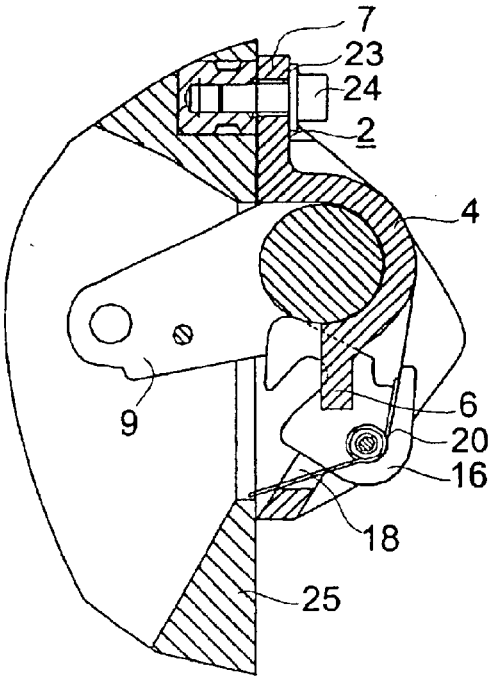
FIG 3
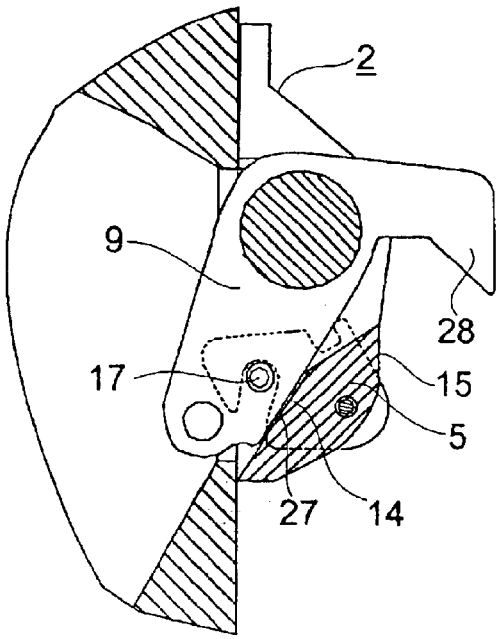
FIG 4

DEVICE FOR ARRANGING THE ACTUATING SHAFT OF A LOW-VOLTAGE CIRCUIT-BREAKER AND MULTIPOLE LOW-VOLTAGE CIRCUIT BREAKER WITH A DEVICE FOR ARRANGING THE ACTUATING SHAFT

This application is the national phase under 35 U.S.C. §371 of PCT International Application No. PCT/DE00/03261 which has an International filing date of Sep. 15, 2000, which designated the United States of America, the entire contents of which are hereby incorporated by reference.

FIELD OF THE INVENTION

The invention generally relates to the field of the design configuration of a circuit breaker which is used in low-voltage networks. It may be related to one which is applicable to the configuration of the bearing for the integral switching shaft of such a switch.

BACKGROUND OF THE INVENTION

Low-voltage circuit breakers have one or more switch poles. The switching contact systems, which include fixed and movable switching contacts, of these switch poles are normally mechanically connected to coupling levers, which are arranged on a switching shaft which is common to all the switch poles.

For such a circuit breaker to operate correctly, it is essential for the switching shaft to have radially precise bearings, with little axial play. A known bearing arrangement which is suitable for this purpose has, in the region of the coupling levers, a bearing assembly which is connected to a housing front wall of the switch pole and contains a bearing body with a cylindrical bearing surface. The production of the switching shaft and its installation are simplified by subdivision into two symmetrical subelements. Each subelement is provided with a radial bearing and an axial bearing at one end by means of the main bearing body. Two further auxiliary bearing bodies are required for the complete axial bearing.

In the case of an integral switching shaft, such a shaft would be permanently connected to the main bearing body by the coupling levers, which are arranged in fixed positions on both sides of the main bearing body. If the main bearing body is faulty, the entire switching shaft must be replaced together with it (DE 197 39 702 C1).

In another known bearing arrangement, the integral switching shaft, which is fitted with all the coupling levers, can be prepositioned in its installed position, independently of the bearing assembly. In this case, the switching shaft is positioned in recesses, which are open at the edges, in walls which are arranged at right angles to the longitudinal axis of the switching shaft. One shaft bearing, which includes two half shells, is then inserted in the axial direction into each of the recesses. Such a shaft bearing provides a radial bearing for the switching shaft away from the points at which the switching forces act. The location of the axial bearing is not mentioned (DE 44 16 090 C1).

SUMMARY OF THE INVENTION

An embodiment of the invention includes an object of designing the bearing assembly such that the switching shaft, which is already prepositioned in its installed position and is provided with the coupling levers, is mounted at the point where the switching forces act. This can be done in a manner such that it is insensitive to tolerances and is convenient for assembly.

According to an embodiment of the invention, an object can be achieved by the bearing body being mounted on the housing front wall of the switch pole, surrounding the switching shaft in the form of a half shell, and by a first subregion of the bearing body being arranged between the coupling levers and forming side guide surfaces for the coupling levers which are connected to the switching shaft.

This configuration allows the bearing assembly and the switching shaft to be replaced independently of one another at any time.

In this case, the bearing assembly has a simple construction and can thus be produced cost-effectively. In addition, it is compact and can thus be installed easily and in a space-saving manner. In addition, the switching shaft bearing can be very largely independent of tolerances, since the switching shaft uses the same bearing body for both radial and axial bearing.

Stops for the on and off positions of the switching contacts can be provided easily, according to one development of the invention, in that a second subregion of the bearing body projects axially beyond the coupling levers and forms stop surfaces for the coupling levers.

If the catch hook, which is normally used in an arrangement such as this, is mounted in a window-like recess in the bearing body such that it can pivot, and the mating piece is in the form of a bolt which passes through the coupling levers, this additional element is integrated in a space-saving manner in the bearing assembly.

One arrangement designed according to the invention for the switching shaft bearing is expediently used in multipole low-voltage circuit breakers in such a way that a bearing assembly at each of the two ends of the switching shaft is associated with the axially outer movable switching contacts. The switching shaft bearing is thus defined statically.

BRIEF DESCRIPTION OF THE DRAWINGS

An exemplary embodiment of the invention is illustrated in FIGS. 1–4 of the drawings, wherein:

FIG. 1 shows a bearing assembly with a bearing body designed according to an embodiment of the invention, FIGS. 3 and 4 show section illustrations of a bearing assembly arranged as shown in FIG. 2.

DETAILED DESCRIPTION OF THE PREFERRED EMBODIMENTS

Figure 2:
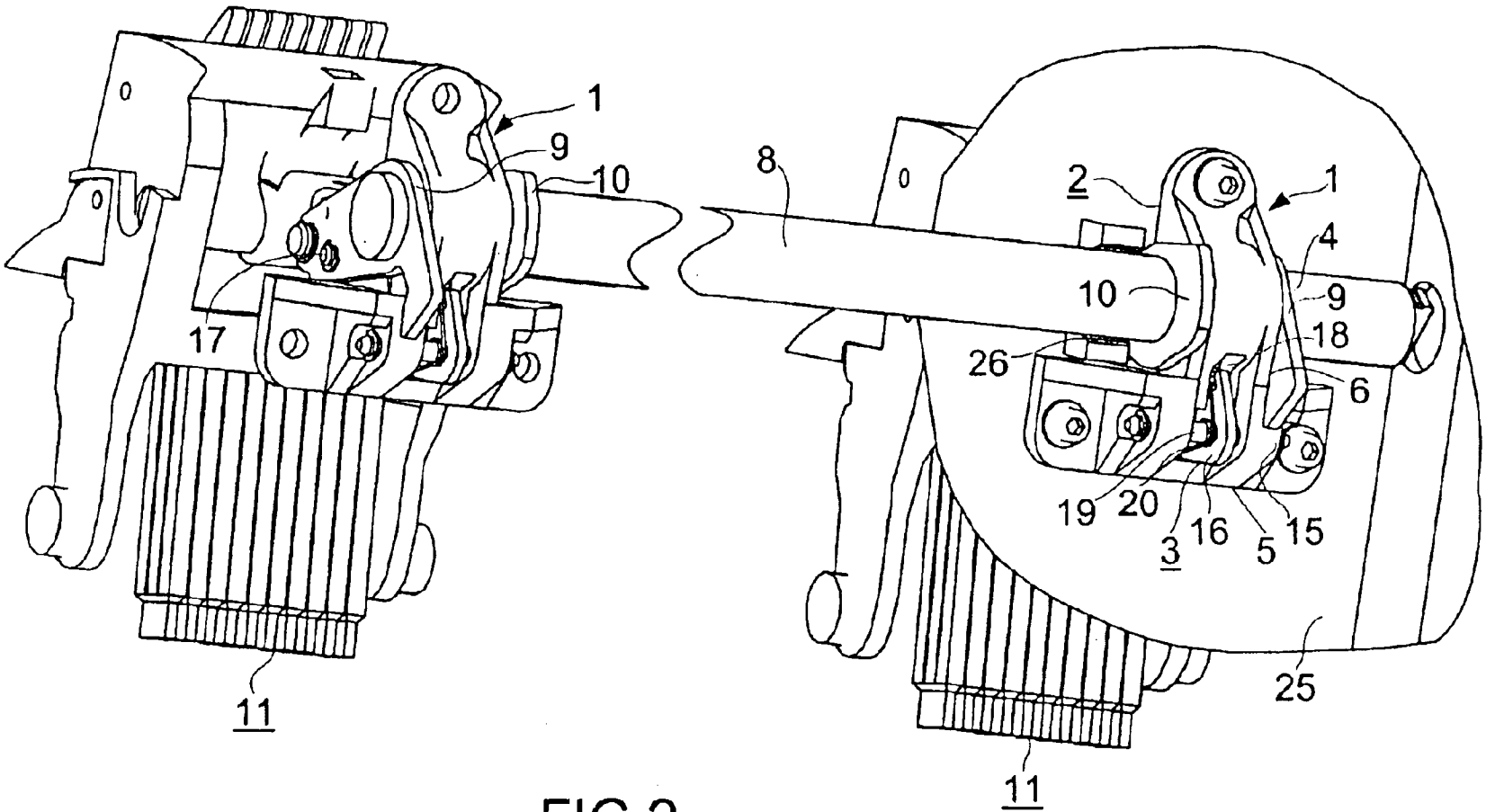
FIG. 2 shows an integral switching shaft with two bearing assemblies (as shown in FIG. 1) arranged at its ends, viewed in perspective.

FIG. 1 shows a bearing assembly 1 with a bearing body 2 and a catch device 3. The bearing body 2 is subdivided into a number of subregions 4, 5, 6, 7, 71 and 72, which are used to provide the bearing for a switching shaft 8, which is illustrated in FIG. 2, the stop for coupling levers 9 and 10 during the switching-on and switching-off processes, the holder for the catch device 3 and the mounting for the bearing assembly 1 on one housing front wall 25 of the switch poles.

As is shown in FIG. 2, the switching shaft 8 is mounted close to its ends by two bearing assemblies 1 as shown in FIG. 1. Two coupling levers 9 and 10 are arranged in each end region of the switching shaft 8 and are used to provide the mechanical connection for a movable switching contact 11 which is associated with an outer switch pole. For this purpose, they are arranged in a fixed position on the switching shaft 8, and are at the same time used to provide the axial bearing for the switching shaft 8. Each bearing assembly 1 has in each case one first subregion 4, whose axial width is matched to the distance between the coupling levers 9 and 10. This first subregion 4 of the bearing body 2 accordingly projects with a small amount of axial play between the coupling levers 9 and 10 and surrounds the switching shaft 8 in the form of a half shell in one direction, which is the opposite direction to that in which the forces occur during the connection process. This first subregion 4 of the bearing body 2 thus forms side guide surfaces 13 (see FIG. 1) for the coupling levers 9 and 10, which are connected in a fixed manner to the switching shaft 8.

A second subregion 5 projects beyond the coupling levers 9 and 10 axially and forms stop surfaces 14 (see FIG. 1) and 15 for the coupling levers 9 and 10, in order to limit the movement of the switching shaft 8. The catch device 3 of each bearing assembly 1 has a catch hook 16 which, during the switching-off process, engages behind a bolt 17 (see also FIG. 4), which passes through both coupling levers 9 and 10. The catch hook 16 is arranged on a bearing bolt 19 in a window-like recess 18 in a third subregion 6 of the bearing body 2, and is mounted such that it can pivot against the force of a wire torsion spring 20. The catch hook 16 and the wire torsion spring 20 can thus be integrated in the bearing assembly easily and in a space-saving manner even before the installation of the bearing assembly 1.

FIG. 3 shows a section through the first and third subregions 4 and 6 of the bearing body 2. The window-like recess 18 for the catch hook 16 has a narrow upper region 21 (see FIG. 1) and a broader lower region 22 (see FIG. 1). The narrow upper region 21 is matched to the width of the catch hook 16 and fixes it axially, except for a small amount of play. The broader lower region 22 is used to provide additional retention for the wire torsion spring 20. The coupling levers 9 and 10 are in the on position here.

The two bearing assemblies 1 have holes 23 in further subregions 7, 71 and 72 (see also FIG. 1) and are connected in a force-fitting and interlocking manner by means of screw connections 24 to the housing front wall 25 of the switch poles. This housing front wall 25 may have a depression 26 in the form of a half shell, as illustrated in FIG. 2, in order to predetermine the installation position of the switching shaft 8, and hence to simplify installation of the switching shaft.

Depending on the length of the switching shaft, auxiliary bearing bodies can be arranged in a known manner to provide an additional bearing for the switching shaft. However, all the switch poles of a multipole low-voltage circuit breaker may also have an associated bearing assembly as shown in FIG. 1.

FIG. 4 shows a section through the second subregion 5 of the bearing body 2, which extends axially outside the coupling levers 9 and 10. Here, however, the coupling levers 9 and 10 are in the off position. At least one of the two coupling levers 9 and 10 is designed such that, during a switching-off process, a section 27 of the circumferential edge of this coupling lever abuts against a first surface 14, which is used as an off stop, of the bearing body 2.

At least one of the two coupling levers 9 and 10 may have a cantilever arm 28 like a hooked nose which, during a switching-on process, abuts against a second surface 15, which is used as an on stop, of the bearing body. An on stop such as this is required, for example, in current-limiting low-voltage circuit breakers.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A bearing arrangement for a switching shaft of a low-voltage circuit breaker, in which two coupling levers are arranged at a distance from one another on an integral switching shaft, for mechanical connection of a movable switching contact associated with one switch pole, comprising:

a bearing assembly, connected to a housing front wall of the switch pole and including a bearing body mounted on the housing front wall of the switch pole, surrounding the switching shaft in the form of a half shell, and wherein a first subregion of the bearing body is arranged between the coupling levers and forms side guide surfaces for the coupling levers, which are connected to the switching shaft.

2. The arrangement as claimed in claim 1, wherein the bearing body includes a second subregion, which projects axially beyond the coupling levers and forms stop surfaces for the coupling levers.

3. The arrangement as claimed in claim 1, wherein the bearing assembly includes a catch hook, whose mating piece forms a bolt which passes through the coupling levers, with the catch hook being mounted in a recess in the bearing body so as to be pivotable.

4. A multipole low-voltage circuit breaker including a bearing arrangement as claimed in claim 1.

5. The arrangement as claimed in claim 2, wherein the bearing assembly includes a catch hook, whose mating piece forms a bolt which passes through the coupling levers, with the catch hook being mounted in a recess in the bearing body so as to be pivotable.

6. A multipole low-voltage circuit breaker including a bearing arrangement as claimed in claim 2.

7. A multipole low-voltage circuit breaker including a bearing arrangement as claimed in claim 3.

8. A multipole low-voltage circuit breaker comprising:

a plurality of switching contacts;

a switching shaft, in which two coupling levers are arranged on the switching shaft for mechanical connection of each movable switching contact, associated with a switch pole; and a bearing assembly connected to a housing front wall of the switch pole and including a bearing body mounted on the housing front wall of the switch pole, surrounding the switching shaft in the form of a half shell, wherein a first subregion of the bearing body is arranged between the coupling levers and forms side guide surfaces for the coupling levers, which are connected to the switching shaft.

9. The multipole low-voltage circuit breaker of claim 8, wherein the bearing body includes a second subregion, which projects axially beyond the coupling levers and forms stop surfaces for the coupling levers.

10. The multipole low-voltage circuit breaker of claim 8, wherein the bearing assembly includes a catch hook, whose mating piece forms a bolt which passes through the coupling levers, with the catch hook being mounted in a recess in the bearing body so as to be pivotable.

* * * * *